United States Patent [19]

Perevozkin et al.

[11] 3,968,827

[45] July 13, 1976

[54] METHOD OF PREPARING CERAMIC CASTING MOULDS FOR POURING METAL THEREIN

[76] Inventors: Jury Leibovich Perevozkin, prospekt Selmash, 36, kv. 81; Anatoly Aramovich Mkrtychian, ulitsa Progressivnaya, 1, kv. 24; Leonid Mikhailovich Baryshevsky, ulitsa Ilicha, 40/26, kv. 22; Vadim Manuilovich Livshits, ulitsa Brestskaya, 9a, kv. 10; Daniel Semenovich Meilikhov, ulitsa Volkova, 10/2, kv. 6; Jury Ivanovich Govorov, ulitsa Vorovskogo, 50, kv. 44; Andrei Stepanovich Beschastny, prospekt Selmash, 36, kv. 89; Fedor Spiridonovich Maximov, prospekt Lenina, 225/1, kv. 37, all of Rostov-na-Donu, U.S.S.R.

[22] Filed: Mar. 7, 1975

[21] Appl. No.: 556,534

[52] U.S. Cl. ..... 164/23; 164/121; 164/39

[51] Int. Cl.[2] ..... B22C 9/00

[58] Field of Search ..... 164/15, 23, 39, 121, 164/361

[56] References Cited

UNITED STATES PATENTS

| | | | |
|---|---|---|---|
| 3,204,303 | 9/1965 | Chandley | 164/23 |
| 3,478,815 | 11/1969 | Worthington | 164/23 X |

FOREIGN PATENTS OR APPLICATIONS

| | | | |
|---|---|---|---|
| 711,940 | 7/1954 | United Kingdom | 164/23 |
| 785,228 | 10/1957 | United Kingdom | 164/23 |

*Primary Examiner*—Ronald J. Shore
*Attorney, Agent, or Firm*—Haseltine, Lake & Waters

[57] ABSTRACT

The method envisages calcining ceramic casting moulds, their cooling to between 30° and 60°C, applying particulate material preheated to a temperature between 600° and 850°C to the outside of the moulds followed by the compacting of the material and keeping the moulds in said preheated particulate material for a period lasting between 10 and 40 minutes.

1 Claim, No Drawings

METHOD OF PREPARING CERAMIC CASTING MOULDS FOR POURING METAL THEREIN

The present invention relates to founding, and more specifically to a method of preparing ceramic casting moulds for pouring metal therein.

For the fabrication of ceramic casting moulds use is made of such materials as grog, dunite, corundum and others displaying adequate thermal stability in combination with suitable binding agents and resistance to cracking at a high temperature.

But the most widely spread and cheapest material for the fabrication of casting moulds is quartz wherein, however, a number of polymorphic transformations occur upon heating, bringing about a considerable swelling of the material when casting moulds are being heat-treated, i.e., calcined or heated up; this swelling results in the deformation and cracking of moulds.

Ceramic casting moulds can also be made in the form of porous shells, single-layer or multi-layer, produced from foamed suspension of a refractory material or a mixture of a foamed refractory suspension with organic additives which burn out during a subsequent calcination so that pores are left, preventing the formation of macrocracks.

There is known a method of preparing ceramic casting moulds for pouring metal therein (I.B. SOKOL, "Heating up and pouring covering forms, fabricated from casting molds", a contribution to "Interaction between a casting mold and product", Moscow, USSR Academy of Sciences, 1962, p. 326–331), wherein ceramic casting moulds are calcined at a temperature between 850° and 900°C. On finishing with the calcination, particulate material preheated to between 600° and 850°C is applied to each mould and then the material is compacted. This completes the preparation of ceramic casting moulds.

In the known method, flaws, i.e., cracks, can occur in moulds during the calcination or moulds can even fracture to pieces. Said flaws are particularly apt to occur in moulds made of quartz-containing material.

When applying particulate material to ceramic casting moulds heated up to between 850° and 900°C, it is a problem to check these moulds for conditions preparatory to pouring metal, to rectify the defects and reject those moulds which are beyond repair. Consequently, there exists the possibility that liquid metal will be poured into defective moulds, inviting reject of castings. Some of the particulate material applied to the moulds from the outside and compacted eventually may enter some of the moulds through cracks and shattered areas, also liquid metal may drain from moulds through cracks. The metal drained so may form burrs and flaskes, making fettling unavoidable, and this adds to the prime cost of castings. A further increase in the prime cost is likely to take place due to scrapping those castings which are defective, the defects being attributed to cracks and the ingress of particulate material into moulds.

It is the object of the present invention to provide a method of preparing ceramic casting moulds for pouring metal therein which assures the preparation of high quality ceramic casting moulds and this, in its turn, enables the production of quality casting at a prime cost which is lower than that of the castings produced in the moulds prepared by the known method.

Said object is attained by a method of preparing ceramic casting moulds for pouring metal therein in which these moulds are calcined and then applied thereto from the outside is a particulate material preheated to between 600° and 850°C and compacted after the application, and in which before the application of particulate material the calcined ceramic casting moulds are cooled down in accordance with the invention to a temperature between 30° and 60°C and after the compacting of the particulate material the moulds are kept therein for a period lasting between 10 and 40 minutes.

The cooling of moulds down to between 30° and 60°C after the calcination enables visual inspection of the calcined moulds for defects and the elimination of the defects, if there are any, before the application of particulate material from the outside. This eliminates the possibility of producing reject castings, increases the number of quality castings and cuts the prime cost of the castings compared with that of the castings produced in the moulds prepared by the known method.

The keeping of a cooled mould for 10 to 40 minutes in compacted particulate material preheated to between 600° and 850°C provides for the heating up of the mould to the requisite temperature preparatory to pouring liquid metal therein. This reduces the thermal shock coming into play when liquid metal is being poured into the mould and also prevents the formation of macrocracks and destruction of moulds.

The essence of the present invention will be best understood from the following detailed description of a preferred embodiment of a method of preparing ceramic casting moulds for pouring metal therein.

Said method is applied in the following way. Moulds, predried and freed of pattern material, are calcined by being heated to between 850° and 900°C and kept at this temperature for a period lasting between 15 and 20 minutes. During the calcination of ceramic casting moulds, the remnants of pattern material burn up and so do the organic additives; furthermore, high-temperature reactions take place, building up the structure of the material of moulds.

The calcined moulds are allowed to cool down to a temperature between 30° and 60°C and after that the moulds are inspected, the defects rectified and those moulds which are beyond repair are rejected.

Sound and repaired moulds are placed into foundry flasks and applied to the moulds from the outside in a particulate material preheated to a temperature between 600° and 850°C. Suitable for use as the particulate material is grog, quartz and dunite with a particle size varying between 0.5 and 10 mm.

On applying particulate material to the moulds placed into foundry flasks, said material is compacted by means of a vibrator for a period lasting 10 to 40 sec so as to form a compact supporting layer around the moulds. The cooled moulds are than kept in the compacted particulate material preheated to between 600° and 850°C for a period lasting between 10 to 40 minutes. As a result of this operation, the moulds cooled before are heated up again to the requisite temperature preparatory to the pouring of metal so that the thermal shock brought about by liquid metal is reduced and this, in its turn, allows to avoid the destruction of moulds and formation of cracks.

Found hereinafter are examples illustrating the method disclosed.

EXAMPLE 1

The material of the mould was quartz used with ethyl silicate as the binder. The particulate material was also quartz preheated to 600°C and the period during which the precooled mould was kept in this heated particulate material was 10 minutes. As a result, the mould was heated up to 450°C.

EXAMPLE 2

The material of the mould was quartz used with ethyl silicate as the binder. Alternatively, with no less success in the example under consideration the binder could be water glass treated with aluminium chloride. The particulate material was dunite preheated to 700°C and the period during which the precooled mould was kept in this heated particulate material was 20 minutes. At the end of this 20-minute period the temperature of the mould was 550°C.

EXAMPLE 3

The material of the mould was dunite used with ethyl silicate as the binder. The particulate material was grog preheated to 800°C and the period during which the precooled mould was kept in this heated particulate material was 20 minutes. At the end of the 20-minute period the temperature of the mould was 650°C.

EXAMPLE 4

The material of the mould was dunite used with ethyl silicate as the binder. The particulate material was quartz preheated to 800°C and the period during which the precooled mould was kept in this heated particulate material was 40 minutes. At the end of the 40-minute period the temperature of the mould was 500°C.

The method disclosed allows to inspect visually the calcined moulds before particulate material is being applied thereto from the outside and to rectify at this stage the defects detected eliminating thus the possibility of producing reject castings. The method is also conducive to an increase in the number of quality castings produced and a reduction in the prime cost of casting compared with the castings obtained from the mould prepared by the known method.

What is claimed is:

1. A method of preparing ceramic casting moulds for pouring metal therein envisaging the following operations: calcining ceramic casting moulds; cooling said moulds to a temperature between 30° and 60°C; applying a particulate material preheated to between 600° and 850°C to the outside of cooled said moulds; compacting said particulate material; keeping the moulds in said particulate material for a period lasting between 10 and 40 minutes.

* * * * *